US009631831B2

(12) United States Patent
Thuillard et al.

(10) Patent No.: US 9,631,831 B2
(45) Date of Patent: Apr. 25, 2017

(54) METHOD FOR CONTROLLING THE OPENING OF AN HVAC VALVE BASED ON THE ENERGY-PER-FLOW GRADIENT

(75) Inventors: Marc Thuillard, Uetikon am See (CH); John S. Adams, Springdale, AR (US)

(73) Assignee: BILIMO HOLDING AG, Hinwil (CH)

( * ) Notice: Subject to any disclaimer, the term of this patent is extended or adjusted under 35 U.S.C. 154(b) by 883 days.

(21) Appl. No.: 13/885,925

(22) PCT Filed: Oct. 18, 2011

(86) PCT No.: PCT/CH2011/000246

§ 371 (c)(1),
(2), (4) Date: Dec. 9, 2013

(87) PCT Pub. No.: WO2012/065275

PCT Pub. Date: May 24, 2012

(65) Prior Publication Data

US 2014/0083673 A1 Mar. 27, 2014

(30) Foreign Application Priority Data

Nov. 17, 2010 (CH) ..... 1926/10

(51) Int. Cl.
*F24F 11/04* (2006.01)
*F24D 19/10* (2006.01)
(Continued)

(52) U.S. Cl.
CPC ..... *F24F 11/04* (2013.01); *F24D 19/1015* (2013.01); *F24D 19/1084* (2013.01); *F24F 3/06* (2013.01); *F24F 11/008* (2013.01)

(58) Field of Classification Search
CPC . F24F 11/04; F24F 3/06; F24F 11/008; F24D 19/1015; F24D 19/1084
See application file for complete search history.

(56) References Cited

U.S. PATENT DOCUMENTS 4,215,408 A * 7/1980 Games ..... G05D 23/20 165/211
4,279,381 A * 7/1981 Yueh ..... F24D 19/1015 165/205

(Continued)

FOREIGN PATENT DOCUMENTS

CN 101354801 A 1/2009
DE 28 11 153 A1 9/1979

(Continued)

OTHER PUBLICATIONS

Communication dated Apr. 10, 2015 from the Chinese Intellectual Property Office issued in corresponding Chinese application No. 201180055591.7.

(Continued)

*Primary Examiner* — Ljiljana Ciric
(74) *Attorney, Agent, or Firm* — Sughrue Mion, PLLC

(57) ABSTRACT

A method for controlling the opening of a valve (10) in an HVAC system (100) to regulate the flow ϕ of a fluid through a thermal energy exchanger (2) of the HVAC system (100) and adjust the amount of energy E exchanged by the thermal energy exchanger (2). According to the method, an energy-per-flow gradient $$\frac{dE}{d\varphi}$$

is determined, and the opening of the valve (10) is controlled depending on the energy-per-flow gradient (Continued)

$$\frac{dE}{d\varphi}.$$

The energy-per-flow gradient $$\frac{dE}{d\varphi}$$

is determined by measuring at consecutive points in time the flow $\phi_1$, $\phi_2$, through the valve (10), by determining the amounts of energy $E_1$, $E_2$ exchanged by the thermal energy exchanger (2) at these points in time, and by calculating the energy-per-flow gradient $$\frac{dE}{d\varphi} = \frac{E_2 - E_1}{\varphi_2 - \varphi_1}$$

from the flow $\phi_1$, $\phi_2$, and exchanged energy $E_1$, $E_2$.

5 Claims, 7 Drawing Sheets

(51) Int. Cl.
*F24F 3/06* (2006.01)
*F24F 11/00* (2006.01)

(56) References Cited

U.S. PATENT DOCUMENTS

| | | | | |
|---|---|---|---|---|
| 4,679,729 | A * | 7/1987 | Petitjean | F24D 3/02 236/91 F |
| 5,806,582 | A | 9/1998 | Santavuori et al. | |
| 2008/0098972 | A1 * | 5/2008 | Elwart | B60K 6/24 123/142.5 E |
| 2009/0287355 | A1 * | 11/2009 | Milder | F24D 19/1051 700/277 |
| 2012/0292006 | A1 * | 11/2012 | Yamashita | F24F 3/06 165/200 |
| 2016/0054741 | A1 * | 2/2016 | Thuillard | F24F 11/008 700/276 |
| 2016/0245544 | A1 * | 8/2016 | Walsh | F24D 19/1084 |

FOREIGN PATENT DOCUMENTS

| | | | | |
|---|---|---|---|---|
| DE | 10 2009 004 319 | A1 | 7/2010 | |
| GB | 2 068 601 | A | 8/1981 | |
| GB | 2 244 152 | A | 11/1991 | |
| JP | WO 2013047828 | A1 * | 4/2013 | F25B 49/02 |
| RU | 2120087 | C1 | 10/1998 | |

OTHER PUBLICATIONS

Communication dated Sep. 1, 2015, issued by the Russian Patent Office in corresponding Russian Application No. 2013127193/12.

* cited by examiner

METHOD FOR CONTROLLING THE OPENING OF AN HVAC VALVE BASED ON THE ENERGY-PER-FLOW GRADIENT

FIELD OF THE INVENTION

The present invention relates to a device and a method for controlling opening of a valve in a Heating, Ventilating and Air Conditioning (HVAC) system. Specifically, the present invention relates to a method and a control device for controlling the opening of a valve in an HVAC system to regulate the flow of a fluid through a thermal energy exchanger of the HVAC system and to thereby adjust the amount of energy exchanged by the thermal energy exchanger.

BACKGROUND OF THE INVENTION

By regulating the flow of fluid through thermal energy exchangers of an HVAC system, it is possible to adjust the amount of energy exchanged by the thermal energy exchangers, e.g. to adjust the amount of energy delivered by a heat exchanger to heat or cool a room in a building or the amount of energy drawn by a chiller for cooling purposes. While the fluid transport through the fluid circuit of the HVAC system is driven by one or more pumps, the flow is typically regulated by varying the opening or position of valves, e.g. manually or by way of actuators. It is known that the efficiency of thermal energy exchangers is reduced at high flow rates where the fluid rushes at an increased rate through the thermal energy exchangers, without resulting in a corresponding increase in energy exchange.

U.S. Pat. No. 6,352,106 describes a self-balancing valve having a temperature sensor for measuring the temperature of a fluid passing through the valve. According to U.S. Pat. No. 6,352,106, the range and thus the maximum opening of the valve are adjusted dynamically, depending on the measured temperature. The opening of the valve is modulated based on a stored temperature threshold value, the current fluid temperature, and a position command signal from a load controller. Specifically, the opening range of the valve is set periodically by a position controller, based on a temperature threshold value stored at the position controller, the current fluid temperature, and the difference between the previously measured fluid temperature and the current fluid temperature. U.S. Pat. No. 6,352,106 further describes an alternative embodiment with two temperature sensors, one placed on the supply line and the other one placed on the return line, for measuring the actual differential temperature over the load, i.e. the thermal energy exchanger. According to U.S. Pat. No. 6,352,10, in this alternative embodiment, the threshold temperature is a threshold differential temperature across the load determined by system requirements of the load. Thus, U.S. Pat. No. 6,352,106 describes controlling the flow based on a change in fluid temperature or a change in a differential temperature over the load. Accordingly, the flow is controlled based on a comparison of determined temperature changes to fixed threshold temperatures or threshold differential temperatures, respectively, which must be predefined and stored at the valve's position controller. Consequently, to avoid incorrect and inefficient settings of the valve, it must be ensured, at initial installation time of the system and whenever thermal energy exchangers are replaced with new models, that the stored threshold temperatures or threshold differential temperatures, respectively, match the type and design parameters of thermal energy exchangers used in the HVAC system.

Document DE 10 2009 004 319 A1 discloses a method for operating a heating or cooling system, whereby the temperature difference between supply temperature and return temperature or only the return temperature is controlled, so that a temperature-based hydraulic balancing of each heat exchanger of the heating or cooling system is achieved, and said balancing is newly adjusted and optimized at each changing of the operation conditions. Although a temperature difference between supply temperature and return temperature is used for control, there is neither a flow meter disclosed, nor the measurement of an energy flow through the heat exchanger, nor the determination of the functional dependency of the energy flow from the mass flow of the heating or cooling medium, nor the use of the gradient of such energy flow/mass flow function as a control parameter.

SUMMARY OF THE INVENTION

It is an object of this invention to provide a method and a control device for controlling the opening of a valve in an HVAC system, which method and a control device do not have at least some of the disadvantages of the prior art. In particular, it is an object of the present invention to provide a method and a control device for controlling the opening of a valve in an HVAC system, without the requirement of having to store fixed threshold temperatures or threshold differential temperatures, respectively.

According to the present invention, these objects are achieved through the features of the independent claims. In addition, further advantageous embodiments follow from the dependent claims and the description.

According to the present invention, the above-mentioned objects are particularly achieved in that for controlling opening (or position) of a valve in an HVAC system to regulate the flow $\phi$ of a fluid through a thermal energy exchanger of the HVAC system and thereby adjust the amount of energy E exchanged by the thermal energy exchanger, an energy-per-flow gradient $$\frac{dE}{d\varphi}$$

is determined, and the opening (or position) of the valve is controlled depending on the energy-per-flow gradient $$\frac{dE}{d\varphi}.$$

Thus, the opening of the valve is controlled depending on the slope of the energy-per-flow curve, i.e. the amount of energy E exchanged by the thermal energy exchanger as a function of the flow of fluid through the thermal energy exchanger. While this energy-per-flow gradient (slope)

$$\frac{dE}{d\varphi}$$

may depend to some extent on the type of thermal energy exchanger, its characteristics for a specific type of thermal energy exchanger can be determined dynamically quite efficiently. Specifically, it is possible to determine easily and efficiently for a specific type of thermal energy exchanger its characteristic energy-per-flow gradient $$\frac{dE}{d\varphi}$$

(slope) in the essentially linear range of the energy-per-flow curve where energy is exchanged efficiently by the thermal energy exchanger. Accordingly, for specific thermal energy exchangers, slope threshold values can be calculated dynamically based on the characteristic energy-per-flow gradient $$\frac{dE}{d\varphi}$$

(slope) determined for the thermal energy exchangers. Consequently, there is no need for storing fixed threshold values.

In a preferred embodiment, the energy-per-flow gradient $$\frac{dE}{d\varphi}$$

is determined by measuring, at a first point in time, the flow $\phi_1$ through the valve, and determining the amount of energy $E_1$ exchanged by the thermal energy exchanger at this first point in time; by measuring, at a subsequent second point in time, the flow $\phi_2$ through the valve, and determining the amount of energy $E_2$ exchanged by the thermal energy exchanger at this second point in time; and by calculating the energy-per-flow gradient $$\frac{dE}{d\varphi} = \frac{E_2 - E_1}{\varphi_2 - \varphi_1}$$

from the flow $\phi_1$, $\phi_2$ and exchanged energy $E_1$, $E_2$ determined for the first and second points in time.

In an embodiment, the amount of energy exchanged by the thermal energy exchanger is determined by measuring the flow $\phi$ through the valve, determining, between an input temperature $T_{in}$ of the fluid entering the thermal energy exchanger and an output temperature $T_{out}$ of the fluid exiting the thermal energy exchanger, a temperature difference $\Delta T=T_{in}-T_{out}$, and calculating, based on the flow $\phi$ through the valve and the temperature difference $\Delta T$, the amount of energy $E=\Delta T\cdot\phi$ exchanged by the thermal energy exchanger.

In a further embodiment, transport efficiency is considered by measuring a transport energy $E_T$ used to transport the fluid through the HVAC system; determining the amount of energy E exchanged by the thermal energy exchanger; determining, based on the transport energy $E_T$ and the amount of energy E exchanged by the thermal energy exchanger, an energy balance $E_B=E-E_T$; comparing the energy balance $E_B$ to an efficiency threshold; and controlling the opening of the valve depending on the comparing.

In case of the thermal energy exchanger of the HVAC system being a heat exchanger, for heating or cooling a room, the opening of the valve is controlled to regulate the flow $\phi$ of the fluid through the heat exchanger of the HVAC system in that the energy-per-flow gradient $$\frac{dE}{d\varphi}$$

is determined while the opening of the valve is being increased; and the opening of the valve is controlled by comparing the energy-per-flow gradient $$\frac{dE}{d\varphi}$$

to a slope threshold, and stopping the increase of the opening when the energy-per-flow gradient $$\frac{dE}{d\varphi}$$

is below the slope threshold.

In case of the thermal energy exchanger of the HVAC system being a chiller, the opening of the valve is controlled to regulate the flow $\phi$ of the fluid through the chiller of the HVAC system in that the energy-per-flow gradient $$\frac{dE}{d\varphi}$$

is determined while the opening of the valve is being increased or decreased; and the opening of the valve is controlled by comparing the energy-per-flow gradient $$\frac{dE}{d\varphi}$$

to a lower slope threshold value and an upper slope threshold value, and by stopping the decrease or increase of the opening when the energy-per-flow gradient $$\frac{dE}{d\varphi}$$

is below the lower slope threshold value or above the upper slope threshold value, respectively.

In an embodiment, the slope threshold is determined by determining the energy-per-flow gradient $$\frac{dE}{d\varphi}$$

at an initial point in time, when the valve is being opened from a closed position, and by setting the slope threshold value based on the energy-per-flow gradient $$\frac{dE}{d\varphi}$$

determined at the initial point in time. For example, the slope threshold value is defined as a defined percentage of the energy-per-flow gradient $$\frac{dE}{d\varphi}$$

determined for the initial point in time. Accordingly, the lower slope threshold value and/or the upper slope threshold value are defined as a defined percentage of the energy-per-flow gradient $$\frac{dE}{d\varphi}$$

determined for the initial point in time. The energy-per-flow gradient $$\frac{dE}{d\varphi}$$

determined at the initial point in time represents the characteristic energy-per-flow gradient $$\frac{dE}{d\varphi}$$

(slope) of a thermal energy exchanger in the essentially linear range of the energy-per-flow curve where energy is exchanged efficiently by the thermal energy exchanger.

In a further embodiment, calibrated are control signal levels which are used to control an actuator of the valve for opening the valve, by setting the control signal to a defined maximum value for placing the valve to a maximum opening position, by reducing the value of the control signal to reduce the opening of the valve while determining the energy-per-flow gradient $$\frac{dE}{d\varphi},$$

and by assigning the maximum value of the control signal to the setting of the valve opening at which the energy-per-flow gradient $$\frac{dE}{d\varphi}$$

becomes equal or greater than a slope threshold value.

In addition to the method of controlling the opening of a valve in an HVAC system, the present invention also relates to a control device for controlling the opening of the valve, whereby the control device comprises a gradient generator configured to determine the energy-per-flow gradient $$\frac{dE}{d\varphi},$$

and a control module configured to control the opening of the valve depending on the energy-per-flow gradient $$\frac{dE}{d\varphi}.$$

Furthermore, the present invention also relates to a computer program product comprising computer program code for controlling one or more processors of a control device for controlling the opening of the valve, preferably a computer program product comprising a tangible computer-readable medium having stored thereon the computer program code. Specifically, the computer program code is configured to control the control device such that the control device determines the energy-per-flow gradient $$\frac{dE}{d\varphi},$$

and controls the opening of the valve depending on the energy-per-flow gradient $$\frac{dE}{d\varphi}.$$

BRIEF DESCRIPTION OF THE DRAWINGS

The present invention will be explained in more detail, by way of example, with reference to the drawings in which.

DETAILED DESCRIPTION OF THE PREFERRED EMBODIMENTS

Figure 1:
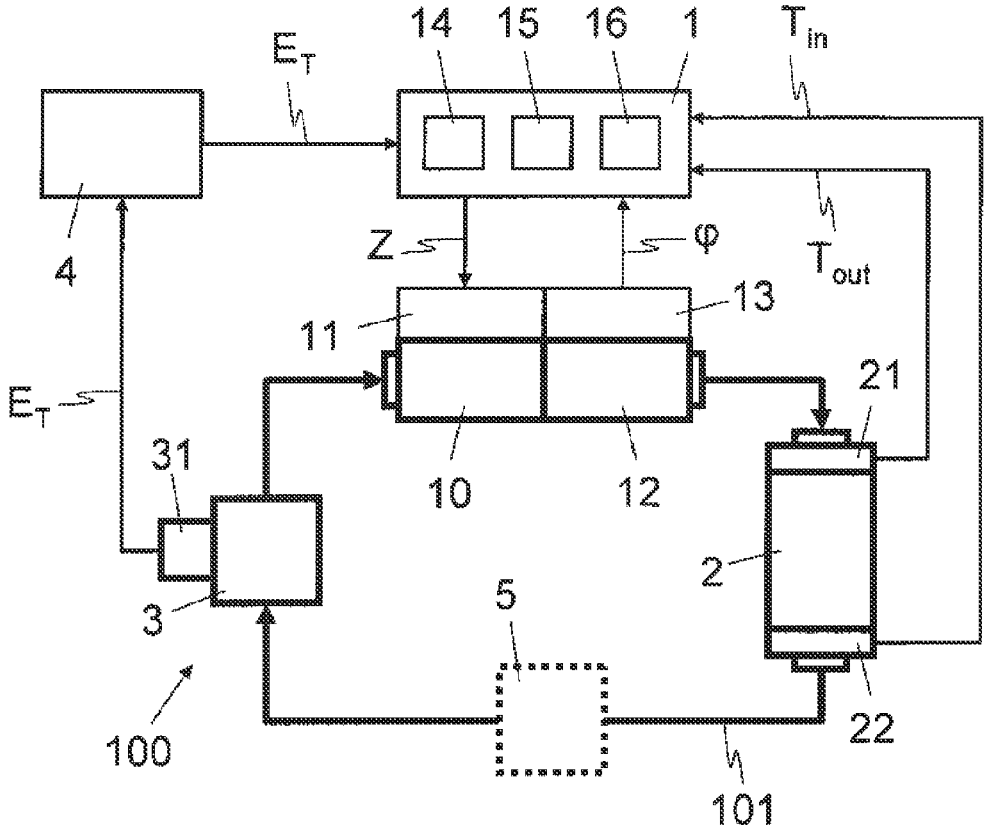
FIG. 1 shows a block diagram illustrating schematically an HVAC system with a fluid circuit comprising a pump, a valve, and a thermal energy exchanger, and a control device for controlling the opening of the valve to regulate the amount of energy exchanged by the thermal energy exchanger.

In FIG. 1, reference numeral 100 refers to an HVAC system with a fluid circuit 101 comprising a pump 3, a valve 10, a thermal energy exchanger 2, e.g. a heat exchanger for heating or cooling a room, and optionally a further thermal energy exchanger in the form of a chiller 5, which are interconnected by way of pipes. The valve 10 is provided with an actuator 11, e.g. an electrical motor, for opening and closing the valve 10 and thus controlling the flow through the fluid circuit 101, using different positions of the valve 10. Further, the pump(s) 3 may themselves vary the flow through the fluid circuit 101. As illustrated schematically, the HVAC system 100 further comprises a building control system 4 connected to the valve 10 or actuator 11, respectively. One skilled in the art will understand that the depiction of the HVAC system 100 is very simplified and that the HVAC system 100 may include a plurality of fluid circuits 101, having in each case one or more pumps 3, valves 19, thermal energy exchangers 2, and optional chillers 5.

As illustrated schematically in FIG. 1, the thermal energy exchanger 2 is provided with two temperature sensors 21, 22 arranged at the inlet of the thermal energy exchanger 2, for measuring the input temperature $T_{in}$ of the fluid entering the thermal energy exchanger 2, and at the exit of the thermal energy exchanger 2, for measuring the output temperature $T_{out}$ of the fluid exiting the thermal energy exchanger 2. For example, the fluid is a liquid heat transportation medium such as water.

The fluid circuit 101 further comprises a flow sensor 13 for measuring the flow $\phi$, i.e. the rate of fluid flow, through the valve 10 or fluid circuit 101, respectively. Depending on the embodiment, the flow sensor 13 is arranged in or at the valve 10, or in or at a pipe section 12 connected to the valve 10. For example, the flow sensor 13 is an ultrasonic sensor or a heat transport sensor.

In FIG. 1, reference numeral 1 refers to a control device for controlling the valve 10 or the actuator 11, respectively, to adjust the opening (or position) of the valve 10. Accordingly, the control device 1 regulates the flow $\phi$, i.e. the rate of fluid flow, through the valve 10 and, thus, through the thermal energy exchanger 2. Consequently, the control device 1 regulates the amount of thermal energy exchanged by the thermal energy exchanger 2 with its environment. Depending on the embodiment, the control device 1 is arranged at the valve 10, e.g. as an integral part of the valve 10 or attached to the valve 10, or the control device 1 is arranged at a pipe section 12 connected to the valve 10.

The control device 1 comprises a microprocessor with program and data memory, or another programmable unit. The control device 1 comprises various functional modules including a gradient generator 14, a control module 15, and a calibration module 16. Preferably, the functional modules are implemented as programmed software modules. The programmed software modules comprise computer code for controlling one or more processors or another programmable unit of the control device 1, as will be explained later in more detail. The computer code is stored on a computer-readable medium which is connected to the control device 1 in a fixed or removable way. One skilled in the art will understand, however, that in alternative embodiments, the functional modules can be implemented partly or fully by way of hardware components.

As is illustrated in FIG. 1, the flow sensor 13 is connected to the control device 1 for providing timely or current-time measurement values of the flow $\phi$ to the control device 1. Furthermore, the control device 1 is connected to the actuator 11 for supplying control signals Z to the actuator 11 for controlling the actuator 11 to open and/or close the valve 10, i.e. to adjust the opening (or position) of the valve 10.

Moreover, the temperature sensors 21, 22 of the thermal energy exchanger 2 are connected to the control device 1 for providing to the control device 1 timely or current-time measurement values of the input temperature $T_{in}$ and the output temperature $T_{out}$ of the fluid entering or exiting the thermal energy exchanger 2, respectively.

Preferably, the control device 1 is further connected to the building control system 4 for receiving from the building control system 4 control parameters, e.g. user settings for a desired room temperature, and/or measurement values, such as the load demand (from zero BTU to maximum BTU) or transport energy $E_T$ currently used by the pump 3 to transport the fluid through the fluid circuit 101, as measured by energy measurement unit 31. Based on the transport energy $E_T$ used by a plurality of pumps 3 and received at the building control system 4 from a plurality of fluid circuits 101 (through transmission in push mode or retrieval in pull mode), the building control system 4 is configured to optimize the overall efficiency of the HVAC system 100, e.g. by setting the flow $\phi$ through the valve 10 of one or more fluid circuits 101 based on the total value of the transport energy $E_T$ used by all the pumps 3 of the HVAC system 100. In an alternative or additional embodiment, an energy sensor arranged at the pump 3 is connected directly to the control device 1 for providing the current measurement value of the transport energy $E_T$ to the control device 1.

In the following paragraphs, described with reference to FIGS. 2-11 are possible sequences of steps performed by the functional modules of the control device 1 for controlling the opening (or position) of the valve 10 to regulate the flow $\phi$ through the thermal energy exchanger 2.

Figure 2:
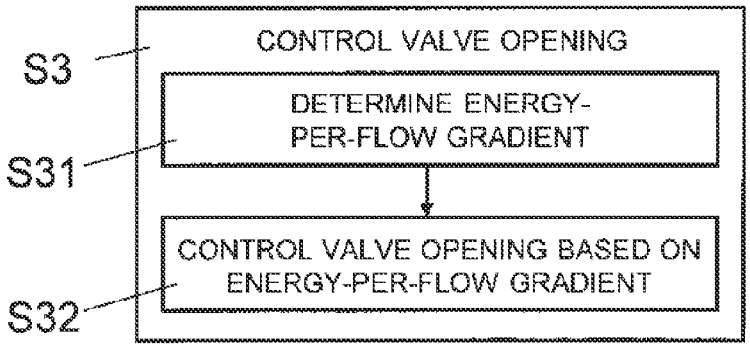
FIG. 2 shows a flow diagram illustrating an exemplary sequence of steps for controlling the opening of the valve.

As illustrated in FIG. 2, in step S3, the control device 1 controls the opening of the valve 10. Specifically, in step S31, the gradient generator 14 determines the energy-per-flow gradient $$\frac{dE}{d\varphi}.$$

In step S32, the control module 15 controls the opening of the valve 10 depending on the energy-per-flow gradient $$\frac{dE}{d\varphi}.$$

Figure 3:
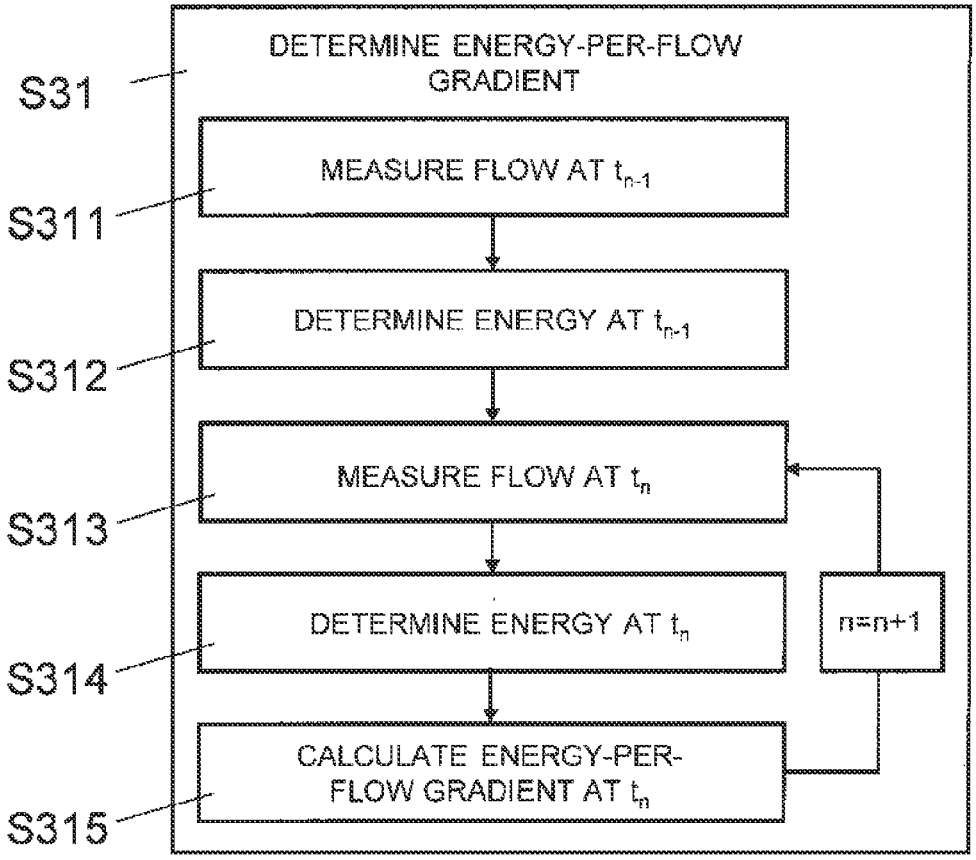
FIG. 3 shows a flow diagram illustrating an exemplary sequence of steps for determining the energy-per-flow gradient of the thermal energy exchanger.
Figure 12:
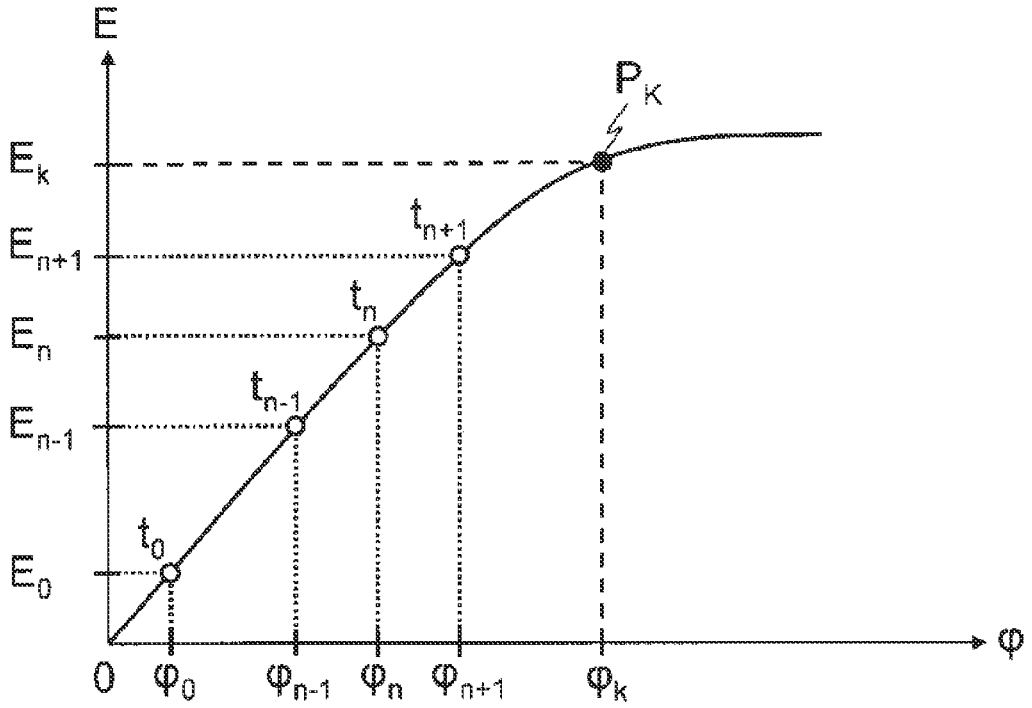
FIG. 12 shows a graph illustrating an example of the energy-per-flow curve with different points in time for determining the energy-per-flow gradient for different levels of flow and corresponding amounts of energy exchanged by the thermal energy exchanger.

As illustrated in FIGS. 3 and 12, for determining the energy-per-flow gradient $$\frac{dE}{d\varphi},$$

in step S311, the gradient generator 14 determines the flow $\phi_{n-1}$ through the valve 10 at a defined time $t_{n-1}$. Depending on the embodiment, the gradient generator 14 determines the flow $\phi_{n-1}$ by sampling, polling or reading the flow sensor 13 at the defined time $t_{n-l}$, or by reading a data store containing the flow measured by the flow sensor 13 at the defined time $t_{n-1}$.

In step S312, the gradient generator 14 determines the amount of energy $E_{n-1}$ exchanged by the thermal energy exchanger 2 at the defined time $t_{n-1}$.

In step S313, the gradient generator 14 determines from the flow sensor 13 the flow $\phi_n$ through the valve 10 at a defined subsequent time $t_n$.

In step S314, the gradient generator 14 determines the amount of energy $E_n$ exchanged by the thermal energy exchanger 2 at the defined subsequent time $t_n$.

In step S315, based on the flow $\phi_{n-1}$, $\phi_n$ and exchanged energy $E_{n-1}$, $E_n$ determined for the defined times $t_{n-1}$, $t_n$, the gradient generator 14 calculates the energy-per-flow gradient $$\frac{dE}{d\varphi} = \frac{E_n - E_{n-1}}{\varphi_n - \varphi_{n-1}}$$

for the defined time $t_n$.

Subsequently, the gradient generator 14 proceeds in steps S313 and S314 by determining the flow $\phi_{n+1}$ and exchanged energy $E_{n+1}$ for the defined time $t_{n+1}$, and calculates the energy-per-flow gradient.

$$\frac{dE}{d\varphi} = \frac{E_{n+1} - E_n}{\varphi_{n+1} - \varphi_n}$$

for the defined time $t_{n+}$, in step S315. Thus, as is illustrated in FIG. 12, the energy-per-flow gradient $$\frac{dE}{d\varphi}$$

is repeatedly and continuously determined for consecutive measurement time intervals $[t_{n-1}, t_n]$ or $[t_n, t_{n+1}]$, respectively, whereby the length of a measurement time interval, i.e. the duration between measurement times $t_{n-1}$, $t_n$, $t_{n+1}$ is, for example, in the range of 1 sec to 30 sec, e.g. 12 sec.

Figure 4:
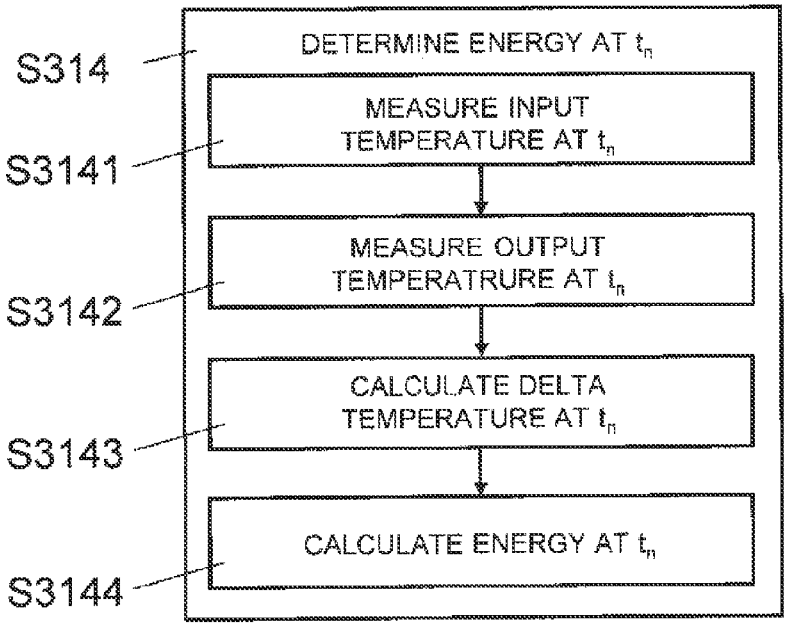
FIG. 4 shows a flow diagram illustrating an exemplary sequence of steps for determining the energy exchanged by the thermal energy exchanger at a given point in time.

As illustrated in FIG. 4, for determining the amount of energy $E_n$ exchanged by the thermal energy exchanger 2 at the defined time $t_n$, in steps S3141 and S3142, the gradient generator 14 determines the input and output temperatures $T_{in}$, $T_{out}$ measured at the inlet or outlet, respectively, of the thermal energy exchanger 2 at the defined time $t_n$. Depending on the embodiment, the gradient generator 14 determines the input and output temperatures $T_{in}$, $T_{out}$ by sampling, polling or reading the temperature sensors 21, 22 at the defined time $t_n$, or by reading a data store containing the input and output temperatures $T_{in}$, $T_{out}$, measured by the temperature sensors 21, 22 at the defined time $t_n$.

In step S3143, the gradient generator 14 calculates the temperature difference $\Delta T = T_{in} - T_{out}$, between the input temperature $T_{in}$ and the output temperature $T_{out}$.

In step S3144, the gradient generator 14 calculates the amount of energy $E_n = \Delta T \cdot \phi_n$ exchanged by the thermal energy exchanger 2 from the flow $\phi_n$ and the temperature difference $\Delta T$ determined for the defined time $t_n$.

Figure 5:
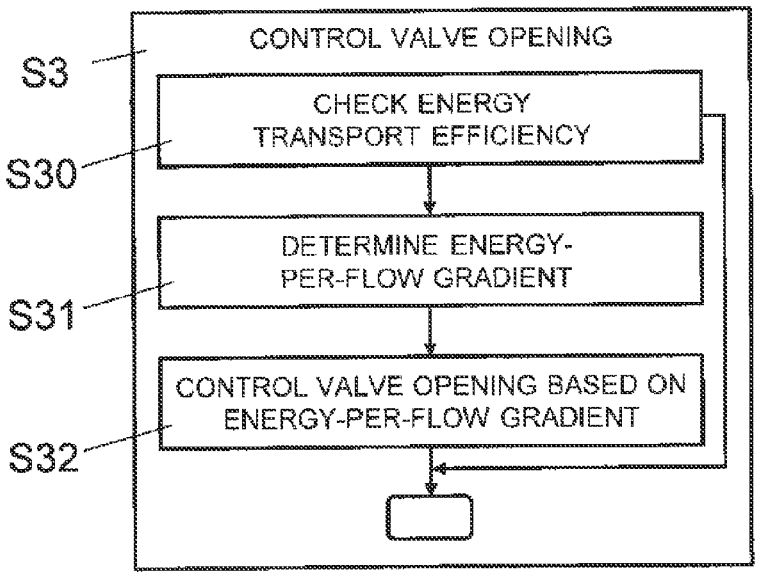
FIG. 5 shows a flow diagram illustrating an exemplary sequence of steps for controlling the opening of the valve including the checking of the efficiency of energy transport in the fluid circuit.

In the embodiment according to FIG. 5, before the energy-per-flow gradient $$\frac{dE}{d\varphi}$$

is determined in step S31, the control module 15 checks the energy transport efficiency in step S30 and, subsequently, controls the opening of the valve depending on the energy transport efficiency. If the energy transport efficiency is sufficient, processing continues in step S31; otherwise, further opening of the valve 10 is stopped and/or the opening of the valve 10 is reduced, e.g. by reducing the control signal Z by a defined decrement.

Figure 6:
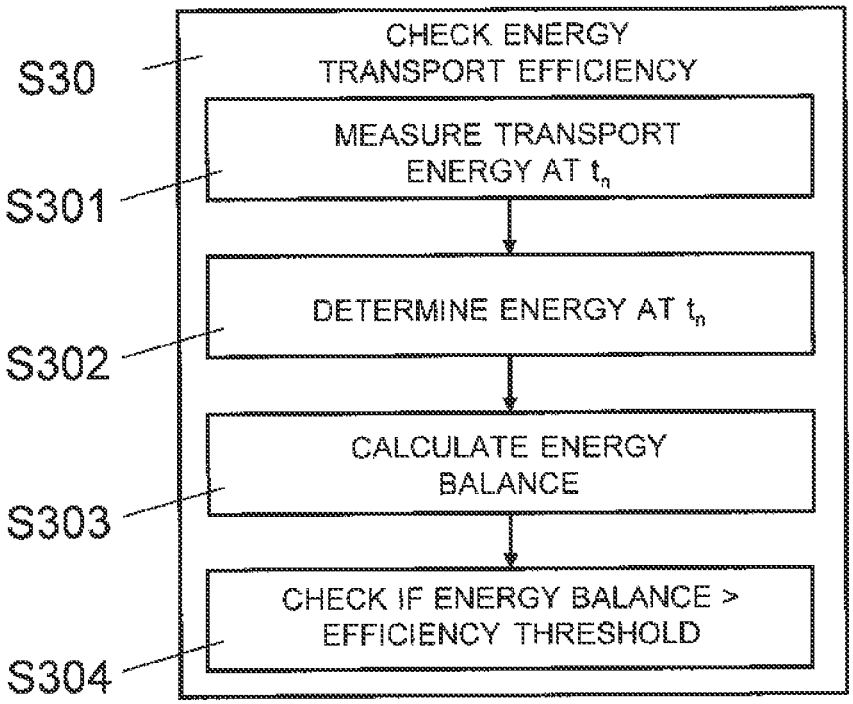
FIG. 6 shows a flow diagram illustrating an exemplary sequence of steps for checking the efficiency of the energy transport in the fluid circuit.

As is illustrated in FIG. 6, for checking the energy transport efficiency, in step S301 the control module 15 measures the transport energy $E_T$ used by the pump 3 to transport the fluid through the fluid circuit 101 to the thermal energy exchanger 2. Depending on the embodiment, the control module 15 determines the transport energy $E_T$ by polling or reading the energy measurement unit 31 at a defined time $t_n$, or by reading a data store containing the transport energy $E_T$ measured by the energy measurement unit 31 at a defined time $t_n$.

In step S302, the control module 15 or the gradient generator 14, respectively, determines the amount of energy $E_n$ exchanged by the thermal energy exchanger 2 at the defined time $t_n$.

In step S303, the control module 15 calculates the energy balance $E_B = E_n - E_T$ from the determined transport energy $E_T$ and amount of exchanged energy $E_n$.

In step S305, the control module 15 checks the energy transport efficiency by comparing the calculated energy balance $E_B$ to an efficiency threshold $K_E$. For example, the energy efficiency is considered positive, if the energy balance $E_B$ exceeds the efficiency threshold $E_B > K_E$, e.g. $K_E = 0$. Depending on the embodiment, the efficiency threshold $K_E$ is a fixed value stored in the control device 1 or entered from an external source.

Figure 7:
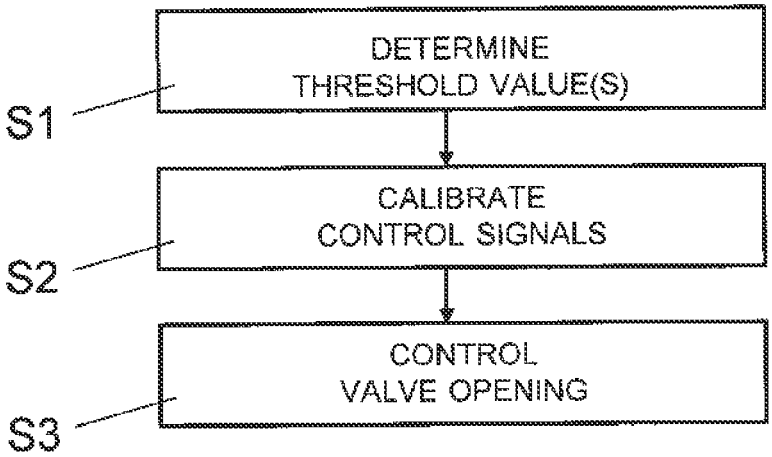
FIG. 7 shows a flow diagram illustrating an exemplary sequence of steps for determining threshold values and/or calibrating control signals used for controlling the opening of the valve.

In the embodiment according to FIG. 7, step S3 for controlling the valve opening is preceded by optional steps S1 and/or S2 for determining one or more slope threshold values and/or calibrating the control signal Z values for controlling the actuator 11 to open and/or close the valve 10. Preferably, for a continuous optimization of system accuracy, the calibration sequence, including steps S1 and/or S2, is not only performed initially, at start-up time, but is re-initiated automatically upon occurrence of defined events, specifically, upon changes of defined system variables such as changes in the input temperature $T_n$ as sensed by the temperature sensor 21; rapid and/or significant changes of various inputs from the building control system 4 such as return air temperature, outside air temperature, temperature drop across the air side of the thermal energy exchanger 2, which may be a heat exchanger; or any signal that represents a change in the load conditions.

Figure 8:
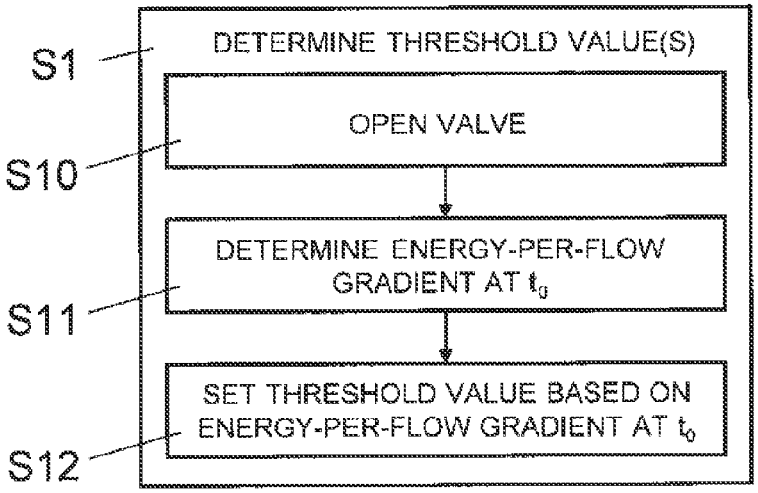
FIG. 8 shows a flow diagram illustrating an exemplary sequence of steps for determining threshold values used for controlling the opening of the valve.

As illustrated in FIG. 8, for determining the slope threshold value(s) for controlling the valve opening, in step S10, the control module 15 opens the valve from an initial closed position. Specifically, in this initial phase, the valve 10 is opened to a defined opening level and/or by a defined increment of the value of the control signal Z.

In step S11, during this initial phase, the gradient generator 14 determines the energy-per-flow gradient $$\frac{dE_0}{d\varphi_0}$$

at an initial point in time $t_0$ (see FIG. 12), as described above with reference to FIG. 3.

In step S12, the control module 15 sets the slope threshold value(s) based on the energy-per-flow gradient $$\frac{dE_0}{d\varphi_0}$$

determined for the initial point in time $t_0$. For example, for a heat exchanger, the slope threshold value $K_0$ is set to a defined percentage C of the energy-per-flow gradient $$K_0 = C \cdot \frac{dE_0}{d\varphi_0},$$

e.g. C=10%. Correspondingly, for a chiller 5, a lower slope threshold value $K_L$ and an upper slope threshold value $K_H$ are set in each case to a defined percentage C, D of the energy-per-flow gradient $$K_L = D \cdot \frac{dE_0}{d\varphi_0},$$

e.g. D=1%, and $$K_H = C \cdot \frac{dE_0}{d\varphi_0},$$

e.g. C=10%. As illustrated in FIG. 12, the slope threshold value $K_0$ defines a point $P_K$ where for a flow $\phi_K$ and amount of energy $E_K$ exchanged by the thermal energy exchanger 2, the energy-per-flow gradient $$\frac{dE_0}{d\varphi_0}$$

is equal to the slope threshold value $K_0$.

In an alternative less preferred embodiment, the slope thresholds $K_0$, $K_L$, $K_H$ are defined (constant) values assigned specifically to the thermal energy exchanger 2, e.g. type-specific constants entered and/or stored in a data store of the control device 1 or the thermal energy exchanger 2.

Figure 9:
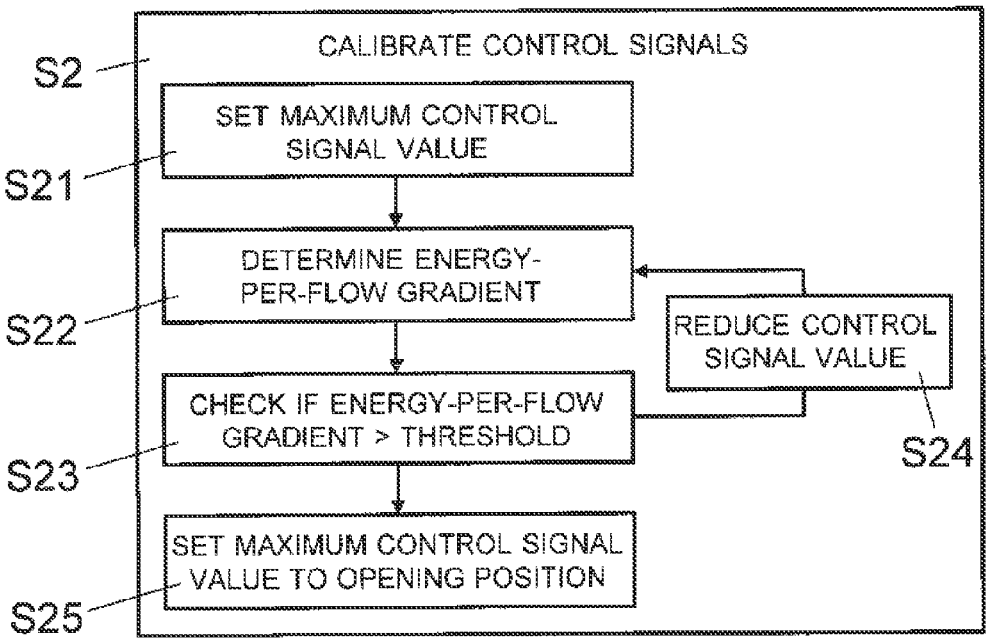
FIG. 9 shows a flow diagram illustrating an exemplary sequence of steps for calibrating control signals used for controlling an actuator of the valve.
Figure 13:
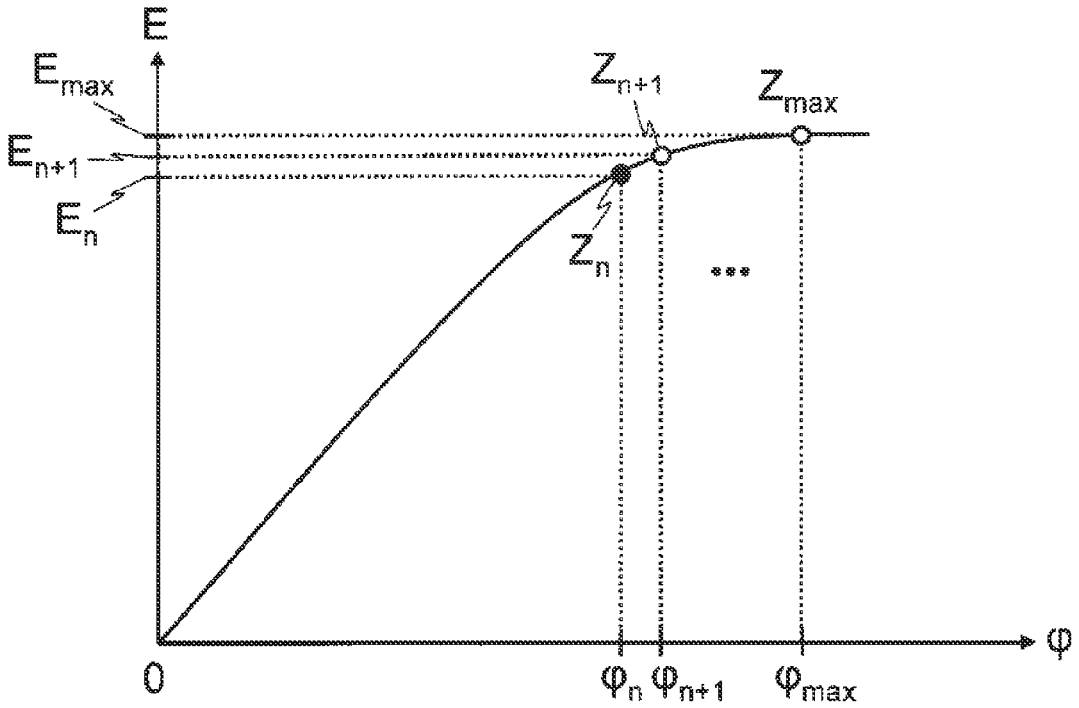
FIG. 13 shows a graph illustrating an example of the energy-per-flow curve with different points in time for determining different energy-per-flow gradients in the process of calibrating control signals used to control an actuator of the valve.

As illustrated in FIGS. 9 and 13, for calibrating the values of the control signal Z, in step S21, the calibration module 16 sets the control signal Z to a defined maximum control signal value $Z_{max}$, e.g. 10V. Accordingly, in the calibration phase, the actuator 11 drives the valve 10 to a maximum opening position, e.g. to a fully open position with maximum flow $\phi_{max}$ corresponding to a maximum BTU (British Thermal Unit).

In step S22, the gradient generator 14 determines the energy-per-flow gradient $$\frac{dE}{d\varphi}$$

as described above with reference to FIG. 3 for the current valve opening.

In step S23, the calibration module 16 checks if the determined energy-per-flow gradient $$\frac{dE}{d\varphi}$$

is greater than the defined slope threshold $K_0$. If $$\frac{dE}{d\varphi} > K_0,$$

processing continues in step S25; otherwise, if $$\frac{dE}{d\varphi} \leq K_0,$$

processing continues in step S24.

In step S24, the calibration module 16 reduces the valve opening, e.g. by reducing the control signal Z by a defined decrement, e.g. by 0.1V, to a lower control signal level $Z_{n+1}$, $Z_n$ and continues by determining the energy-per-flow gradient $$\frac{dE}{d\varphi}$$

for the reduced opening of the valve 10 with reduced flow $\phi_{n+1}$, $\phi_n$.

In step S25, when the valve 10 is set to an opening where the energy-per-flow gradient $$\frac{dE}{d\varphi}$$

exceeds the defined slope threshold $K_0$, e.g. for a control signal $Z_n$ with flow $\phi_n$, the calibration module 16 calibrates the control signal Z by assigning the maximum value for the control signal $Z_{max}$ to the current opening level of the valve 10. For example, if $$\frac{dE}{d\varphi} > K_0$$

is reached with a control signal $Z_n$ of 8V at an opening level of the valve 10 of 80% with flow $\phi_n$, the maximum value $Z_{max}$ of e.g. 10V for the control signal Z is assigned to the opening level of 80%. When the control signal Z is subsequently set to its maximum level $Z_{max}$, e.g. as required by a load demand from the building control system 4, the valve 10 is set to an opening level with flow $\phi_n$, that results in an energy-per-flow gradient $$\frac{dE_n}{d\varphi_n}$$

equal to or greater than the defined slope threshold value $K_0$.

Figure 10:
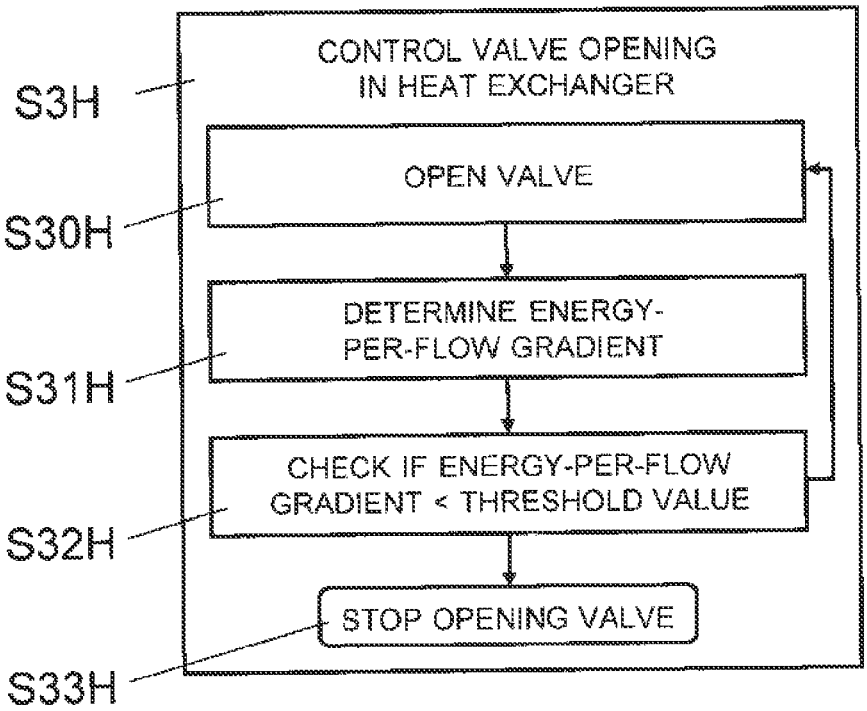
FIG. 10 shows a flow diagram illustrating an exemplary sequence of steps for controlling the opening of the valve in a fluid circuit with a heat exchanger.

FIG. 10 illustrates an exemplary sequence of steps S3H for controlling the valve opening for a thermal energy converter 2 in the form of a heat exchanger.

In step S30H, the control module 15 opens the valve 10 from an initial closed position. Specifically, in this initial phase, the valve 10 is opened to a defined opening level and/or by a defined increment of the value of the control signal Z.

In step S31H, the gradient generator 14 determines the energy-per-flow gradient $$\frac{dE}{d\varphi}$$

as described above with reference to FIG. 3 for the current valve opening.

In step S32H, the control module 15 checks whether the determined energy-per-flow gradient $$\frac{dE}{d\varphi}$$

is smaller than the defined slope threshold $K_0$.

If the energy-per-flow gradient $$\frac{dE}{d\varphi}$$

is greater or equal to the defined slope threshold $K_0$, processing continues in step S30H by continuing to increase the control signal Z to further open the valve 10. Otherwise, if the energy-per-flow gradient $$\frac{dE}{d\varphi}$$

is below the defined slope threshold $K_0$, processing continues in step S33H by stopping further opening of the valve 10 and/or by reducing the opening of the valve 10, e.g. by reducing the control signal Z by a defined decrement.

Figure 11:
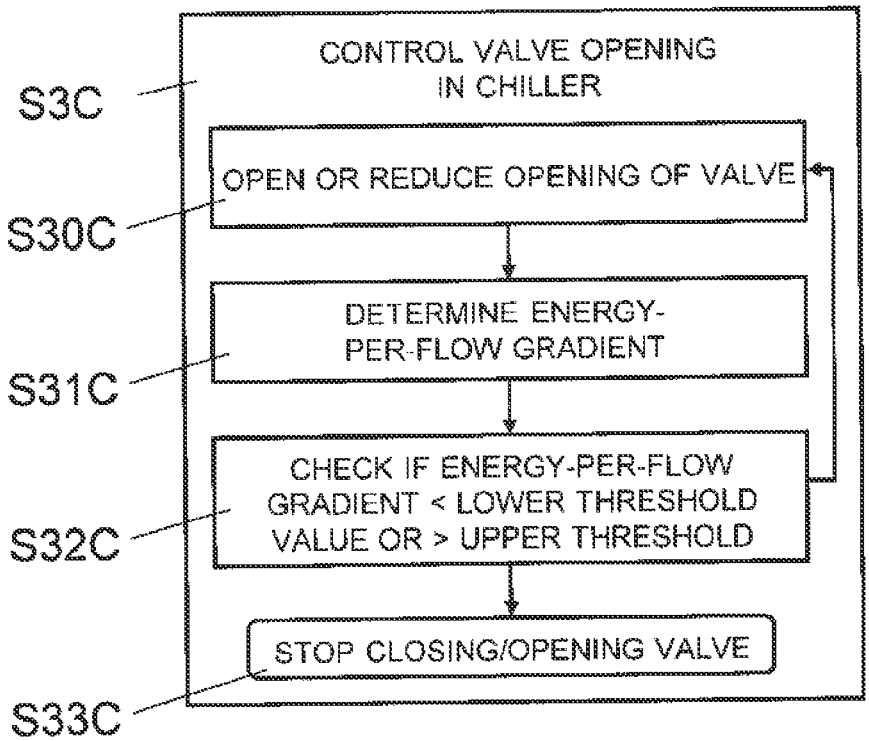
FIG. 11 shows a flow diagram illustrating an exemplary sequence of steps for controlling the opening of the valve in a fluid circuit with a chiller.

FIG. 11 illustrates an exemplary sequence of steps S3C for controlling the valve opening for a thermal energy converter in the form of a chiller 5.

In step S30C, the control module 15 opens the valve 10 from an initial closed position or reduces the opening from an initial open position. Specifically, in this initial phase, the valve 10 is opened or its opening is reduced, respectively, to a defined opening level and/or by a defined increment (or decrement) of the value of the control signal Z.

In step S31C, the gradient generator 14 determines the energy-per-flow gradient $$\frac{dE}{d\varphi}$$

as described above with reference to FIG. 3 for the current valve opening.

In step S32C, the control module 15 checks whether the determined energy-per-flow gradient $$\frac{dE}{d\varphi}$$

is smaller than the defined lower slope threshold value $K_L$ or greater than the defined upper slope threshold value $K_H$.

If the energy-per-flow gradient $$\frac{dE}{d\varphi}$$

is greater or equal to the defined lower slope threshold $K_L$ and smaller or equal to the upper slope threshold $K_H$, processing continues in step S30C by continuing to increase the control signal Z to further open the valve 10 or by continuing to decrease the control signal Z to further close the valve 10, respectively. Otherwise, if the energy-per-flow gradient $$\frac{dE}{d\varphi}$$

is smaller than the defined lower slope threshold value $K_L$ or greater than the defined upper slope threshold value $K_H$, processing continues in step S33C by stopping further opening or closing of the valve 10, respectively, as the chiller 5 no longer operates in the efficient range.

It should be noted that, in the description, the computer program code has been associated with specific functional modules and the sequence of the steps has been presented in a specific order, one skilled in the art will understand, however, that the computer program code may be structured differently and that the order of at least some of the steps could be altered, without deviating from the scope of the invention.

The invention claimed is:

1. A method of controlling opening of a valve in an HVAC system to regulate the flow $\phi$ of a fluid through a thermal energy exchanger of the HVAC system and to adjust the amount of energy E exchanged by the thermal energy exchanger, the method comprising:

determining an energy-per-flow gradient $$\frac{dE}{d\varphi};$$

controlling the opening of the valve depending on the energy-per-flow gradient $$\frac{dE}{d\varphi};$$

measuring a transport energy $E_T$ used to transport the fluid through the HVAC system;

determining the amount of energy E exchanged by the thermal energy exchanger;

determining, based on the transport energy $E_T$ and the amount of energy E exchanged by the thermal energy exchanger, an energy balance $E_B=E-E_T$;

comparing the energy balance $E_B$ to an efficiency threshold, the efficiency threshold being one of: a fixed value stored in a control device and a value entered from an external source; and controlling the opening of the valve based on the comparing.

2. A method of controlling opening of a valve in an HVAC system to regulate the flow ϕ of a fluid through a heat exchanger of the HVAC system and to adjust the amount of energy E exchanged by the heat exchanger, the method comprising:

determining an energy-per-flow gradient $$\frac{dE}{d\varphi};$$

and controlling the opening of the valve depending on the energy-per-flow gradient $$\frac{dE}{d\varphi};$$

wherein the opening of valve is controlled to regulate the flow ϕ of the fluid through the heat exchanger; the energy-per-flow gradient $$\frac{dE}{d\varphi}$$

is determined while the opening of the valve is being increased; and the opening of the valve is controlled by comparing the energy-per-flow gradient $$\frac{dE}{d\varphi}$$

to a slope threshold and by stopping the increase of the opening when the energy-per-flow gradient $$\frac{dE}{d\varphi}$$

is below the slope threshold.

3. The method of claim 2, further comprising determining the slope threshold by determining the energy-per-flow gradient $$\frac{dE}{d\varphi}$$

at an initial point in time, when the valve is being opened from a closed position, and by setting the slope threshold value based on the energy-per-flow gradient $$\frac{dE}{d\varphi}$$

determined at the initial point in time.

4. A method of controlling opening of a valve in an HVAC system to regulate the flow ϕ of a fluid through a chiller of the HVAC system and to adjust the amount of energy E exchanged by the chiller, the method comprising:

determining an energy-per-flow gradient $$\frac{dE}{d\varphi};$$

controlling the opening of the valve depending on the energy-per-flow gradient $$\frac{dE}{d\varphi};$$

wherein the valve is controlled to regulate the flow ϕ of the fluid through the chiller; the energy-per-flow gradient $$\frac{dE}{d\varphi}$$

is determined while the opening of the valve is being increased or decreased; and the opening of the valve is controlled by comparing the energy-per-flow gradient $$\frac{dE}{d\varphi}$$

to a lower slope threshold value and to an upper slope threshold value, by stopping the decrease of the opening when the energy-per-flow gradient $$\frac{dE}{d\varphi}$$

is below the lower slope threshold value or above the upper slope threshold value, and by stopping the increase of the opening when the energy-per-flow gradient $$\frac{dE}{d\varphi}$$

is below the lower slope threshold value or above the upper slope threshold value.

5. A method of controlling opening of a valve in an HVAC system to regulate the flow ϕ of a fluid through a thermal energy exchanger of the HVAC system and to adjust the amount of energy E exchanged by the thermal energy exchanger, the method comprising:

determining an energy-per-flow gradient $$\frac{dE}{d\varphi};$$

controlling the opening of the valve depending on the energy-per-flow gradient $$\frac{dE}{d\varphi};$$

calibrating control signal levels which are used to control an actuator of the valve for opening the valve, by setting a control signal to a defined maximum value for placing the valve to a maximum opening position, reducing the value of the control signal to reduce the opening of the valve while determining the energy-per-flow gradient $$\frac{dE}{d\varphi},$$

and assigning the maximum value of the control signal to a setting of the valve opening at which the energy-per-flow gradient $$\frac{dE}{d\varphi}$$

becomes equal to or greater than a slope threshold value, the slope threshold value being one of: a defined percentage of the energy-per-flow gradient $$\frac{dE}{d\varphi}$$

and a constant value assigned to the thermal energy exchanger.

* * * * *